US008689988B2

(12) United States Patent
Xu et al.

(10) Patent No.: US 8,689,988 B2
(45) Date of Patent: Apr. 8, 2014

(54) BOTTLE CAP HAVING REMOVAL TRACKING INDICIA

(71) Applicants: Tao Xu, Naperville, IL (US); Xiaojun Zhang, Shenzhen (CN); Linzhi Fang, Shenzhen (CN)

(72) Inventors: Tao Xu, Naperville, IL (US); Xiaojun Zhang, Shenzhen (CN); Linzhi Fang, Shenzhen (CN)

( * ) Notice: Subject to any disclaimer, the term of this patent is extended or adjusted under 35 U.S.C. 154(b) by 0 days.

(21) Appl. No.: 13/887,943

(22) Filed: May 6, 2013

(65) Prior Publication Data

US 2013/0292354 A1 Nov. 7, 2013

Related U.S. Application Data

(60) Provisional application No. 61/688,030, filed on May 7, 2012.

(51) Int. Cl.
*B65D 25/56* (2006.01)
*B65D 50/00* (2006.01)

(52) U.S. Cl.
USPC ..... 215/230; 215/206; 215/228; 215/365; 215/DIG. 3; 116/308; 116/309; 206/459.1; 206/459.5; 220/212

(58) Field of Classification Search
USPC ..... 116/307–309; 206/459.1, 459.5, 534; 215/206, 220, 228, 230, 272–274, 276, 215/277, 280, 281, 283, 317, 318, 321, 215/329–340, 365, DIG. 3; 220/290, 324, 220/325
See application file for complete search history.

(56) References Cited

U.S. PATENT DOCUMENTS

| | | | | | |
|---|---|---|---|---|---|
| 261,131 | A | * | 7/1882 | Bonshire | 116/309 |
| 2,450,949 | A | * | 10/1948 | Gattuccio et al. | 116/308 |
| 3,446,179 | A | * | 5/1969 | Bender | 116/308 |
| 3,766,882 | A | * | 10/1973 | Babbitt, III | 116/308 |
| 4,345,541 | A | * | 8/1982 | Villa-Real | 116/308 |
| 4,705,182 | A | * | 11/1987 | Newel-Lewis | 215/230 |
| 4,802,438 | A | * | 2/1989 | DeJonge | 116/308 |
| 4,920,912 | A | * | 5/1990 | Kirkling | 116/308 |
| 5,009,338 | A | | 4/1991 | Barker | |
| 5,082,129 | A | * | 1/1992 | Kramer | 215/221 |
| 5,184,739 | A | | 2/1993 | Kusz | |
| 5,188,251 | A | | 2/1993 | Kusz | |
| 5,242,067 | A | * | 9/1993 | Garby et al. | 215/230 |
| 5,261,548 | A | | 11/1993 | Barker et al. | |
| 5,297,687 | A | * | 3/1994 | Freed | 215/206 |
| 5,299,701 | A | | 4/1994 | Barker et al. | |
| RE34,930 | E | | 5/1995 | Kusz | |
| 5,638,970 | A | | 6/1997 | Garby et al. | |
| 5,676,268 | A | | 10/1997 | King | |
| 5,678,712 | A | | 10/1997 | Rios | |

(Continued)

*Primary Examiner* — J. Gregory Pickett
*Assistant Examiner* — Ned A Walker
(74) *Attorney, Agent, or Firm* — Christopher J. Scott

(57) ABSTRACT

An indexing cap assembly indexes visual cues or indicia during an open and close cycle so as to help users more easily track container entry as for example with regard to medications so as to ensure proper dosage. The indexing cap assembly basically incorporates six components, including a cover construction, an indexing plate or wheel, a compression coil or spring, a push plate construction, a gear tray or swing plate construction, and an assembly ring. The cover construction and assembly ring are joined together to essentially form or close the cap assembly with the other parts coaxially aligned and operable therebetween. The indexing wheel is rotatively received within the cover construction such that axial displacements of the push plate advance the indexing wheel and indicia upon its upper surface are sequentially revealed by way of the window formed in the cover construction.

17 Claims, 17 Drawing Sheets

(56) References Cited

U.S. PATENT DOCUMENTS

| | | | | | |
|---|---|---|---|---|---|
| 5,732,836 | A | | 3/1998 | Barker et al. | |
| 5,803,283 | A | | 9/1998 | Barker et al. | |
| 5,860,387 | A | | 1/1999 | Giveen | |
| 6,003,467 | A | * | 12/1999 | Shelton-Ferrell et al. | 116/309 |
| 6,016,764 | A | | 1/2000 | Giveen | |
| 6,059,133 | A | * | 5/2000 | Lai | 215/230 |
| 6,068,149 | A | * | 5/2000 | Telega | 215/230 |
| D439,534 | S | * | 3/2001 | Scarrott et al. | D10/96 |
| D481,946 | S | * | 11/2003 | Nicholson et al. | D9/436 |
| 6,779,480 | B2 | * | 8/2004 | Zamjahn | 116/308 |
| 6,904,867 | B2 | * | 6/2005 | Zamjahn | 116/308 |
| 7,222,736 | B1 | * | 5/2007 | Seijas | 206/534 |
| 7,556,151 | B2 | * | 7/2009 | Seijas | 206/534 |
| 7,584,712 | B2 | * | 9/2009 | Lu | 116/307 |
| 7,650,883 | B2 | | 1/2010 | Scarrott et al. | |
| 7,661,384 | B2 | * | 2/2010 | Mataya | 116/311 |
| 7,665,611 | B2 | * | 2/2010 | Koch | 206/534 |
| 7,757,688 | B2 | | 7/2010 | Scarrott et al. | |
| 7,857,134 | B2 | | 12/2010 | Koch | |
| 7,959,023 | B2 | | 6/2011 | Ferrara | |
| 8,074,594 | B2 | | 12/2011 | Lu | |
| 8,074,643 | B2 | | 12/2011 | Scarrott et al. | |
| 8,157,128 | B2 | | 4/2012 | Blacker et al. | |
| 8,181,591 | B1 | | 5/2012 | Gulka et al. | |
| 2003/0000452 | A1 | * | 1/2003 | Zamjahn | 116/315 |
| 2003/0192468 | A1 | * | 10/2003 | Goertzen | 116/309 |
| 2004/0206295 | A1 | * | 10/2004 | Zamjahn | 116/309 |
| 2006/0180566 | A1 | * | 8/2006 | Mataya | 215/230 |
| 2007/0056502 | A1 | * | 3/2007 | Lu | 116/307 |
| 2007/0187282 | A1 | * | 8/2007 | Seijas | 206/534 |
| 2008/0000792 | A1 | * | 1/2008 | Koch | 206/459.5 |
| 2008/0099423 | A1 | * | 5/2008 | Koch | 215/230 |
| 2008/0302797 | A1 | * | 12/2008 | Phillips | 220/266 |
| 2009/0120898 | A1 | * | 5/2009 | Hunt et al. | 215/230 |
| 2009/0139950 | A1 | * | 6/2009 | Greter et al. | 215/11.5 |
| 2009/0314733 | A1 | * | 12/2009 | Pfenniger et al. | 215/11.1 |
| 2009/0314734 | A1 | * | 12/2009 | Pfenniger et al. | 215/11.1 |
| 2009/0314736 | A1 | * | 12/2009 | Rigert et al. | 215/11.4 |
| 2010/0140204 | A1 | * | 6/2010 | Vischer | 215/11.1 |
| 2012/0103849 | A1 | * | 5/2012 | Rachuk et al. | 206/459.1 |

* cited by examiner

BOTTLE CAP HAVING REMOVAL TRACKING INDICIA

BACKGROUND OF THE INVENTION

1. Prior History

This application claims the benefit of U.S. Provisional Patent Application No. 61/688,030, filed in the United States Patent and Trademark Office on 7 May 2012, the specifications of which are hereby incorporated by reference thereto.

2. Field of the Invention

The present invention relates generally to a cap device for enabling a user to track the container entry events with the cap device. More particularly, the present invention relates to an indexing bottle cap device for advancing a visual cue every time the indexing cap assembly is attached to a container, which indexing cap assembly effectively mechanically resets itself ever time the cap assembly is detached from the container.

BRIEF DESCRIPTION OF THE PRIOR ART

U.S. Pat. No. 5,009,338 ('338 Patent), issued to Barker, discloses an Indicator Cap for a Medicine Bottle. The Barker '338 patent describes an indicator cap for indicating each time a bottle is opened and re-closed having an outer cover shaped in the manner of a conventional bottle cap with a window in the top piece of the cap. The cap is designed to be attached to the sealing cap of the container such that some motion can occur between the two caps during opening and closing of the container, and this lost motion drive is used to advance the indicator.

Underneath the window, and within the body of the device, is an indicator wheel having numbers, days, times, etc. engraved or printed thereon which are visible through the window to indicate the next time a dose of the medication should be taken. The indicator wheel contains a pawl formed therein or attached thereto that engages a set of teeth, formed in the underside of the top piece of the outer cover, only when the device is being opened. This engagement causes the indicator wheel to move to the next index location each time the cap is opened.

Underneath the indicator wheel, and attached to the outer cover is a snap cover which contains a pawl formed therein or attached thereto. The pawl engages a set of teeth on the indicator wheel to prevent the indicator wheel from moving with respect to the ratchet when the device is being closed. The pawls on the two wheels, and the teeth formed opposite the pawls are designed such that the index wheel moves to a new location upon opening the cap, and is kept in that location when the cap is closed, allowing the window in the top piece to uncover the next indicator as the device is closed.

Both pawls are formed or attached such that space is provided for the pawl to move out of the way when being moved in a direction where the teeth are disengaged. The pawl moves away from the teeth as the teeth slide over the pawl, and as the movement is completed, the pawl makes an audible sound as it snaps back into place.

Thus, the device makes a sound when it has been opened a sufficient amount for the index to move to the next location, and it also makes a sound when is has been closed sufficiently to re-cock the mechanism for the next cycle. The device also has an extension plug that attaches between the snap cover and the sealing cap to allow the indicator cap to be attached to a sealing cap that is larger than the outer cover. Also disclosed in an alternative embodiment wherein the snap cover and the sealing cap are formed as a single unit.

U.S. Pat. No. 5,299,701, issued to Barker et al. discloses an Indicator Cap. The Barker et al. indicator cap counts the number of times a container has been opened or some other event has occurred, with particular usefulness in medicine bottles and the like. An outer cover portion with a set of teeth holds an indicator wheel with an engaging pawl and another set of teeth and a ratchet wheel with another pawl. The pawls and teeth in combination with a slot for engaging the ratchet wheel result in a lost motion drive in which the outer cover will turn relative to the indicator wheel each time the container is opened or closed or some other event occurs. Various embodiments of the invention include means for using the cap with child-resistant containers, means for attaching the cap to containers and means to facilitate the manufacture and assembly of the device.

The reader may wish to also reference U.S. Pat. No. 5,261,548, disclosing an Indicator Cap or Use with Threaded or Bayonet Lug Container; U.S. Pat. No. 5,732,836, disclosing an Indicator Closure for Closing a Container; and U.S. Pat. No. 5,803,283, disclosing a Snap-On Indicator Cap, all of which issued to Barker et al. and bear certain similarities to one another. Further related to the foregoing subject matter is U.S. Pat. No. 5,638,970, issued to Garby et al., which discloses a Child-Resistant Indicator Cap.

U.S. Pat. No. 5,184,739 ('739 Patent) and U.S. Pat. No. 5,188,251 ('251 Patent), issued to Kusz, both disclose Child Resistant Reminder Closure devices. The Kusz patents both describe child resistant reminder closure device(s) comprising an outer closure member having a base wall and a peripheral skirt, an inner closure member having a base wall and a peripheral skirt with a bead on the outer closure member retaining the inner closure member for limited axial outward movement relative to the outer closure member.

An indicator or a day disk is provided on the outer surface of the inner closure member and is rotatable relative to the outer and inner closure members. A first set of flexible radial ratcheting fingers extend radially from the indicator disk and engage radial lugs on the undersurface of the base wall of the outer closure member. A second set of flexible radial ratcheting fingers extend radially from the indicator disk and engage circumferentially spaced lugs on the upper surface of the inner closure member.

Axially interengageable lugs are provided on the outer closure and the inner closure members are interengaged to remove the closure or to apply the closure to a container thereby providing a child resistant function. A window in the outer closure member is associated with indicia on the day disk to indicate the circumferential position of the outer closure member relative to the day disk.

U.S. Pat. No. 5,676,268 ('268 Patent), issued to King, discloses a Child Resistant Closure with Castellations. The King '268 Patent describes a container neck and child-resistant closure for the neck. The closure includes an inner part and an outer part, and castellations on the parts which mate when the outer part is displaced axially, to lock the parts together for rotation. A ratchet mechanism including ratchet ramps and cantilever leaf springs biases the inner and outer parts axially and rotationally apart, and allows relative rotation of the parts in one direction of rotation, when the castellations are not engaged.

The angle through which outer part has to be turned to enable the castellations to be engaged may be less than 45 degrees and preferably less than 25 degrees. The closure may be moved between fully opened and closed positions by rotation through less than 360 degrees and preferably about 90 degrees. A tamper-evident ring, and a retaining means for retaining the closure in the closed position, may also be provided.

U.S. Pat. No. 5,678,712 ('712 Patent), issued to Rios, discloses a Child Resistant Reminder Closure. The Rios '712 Patent describes a child resistant reminder closure device comprising an outer closure member having a base wall and a peripheral skirt, an inner closure member having a base wall and a peripheral skirt. A day disk is provided adjacent the inner surface of the base wall of the outer closure member. An indexing disk is provided adjacent the day disk. The day disk has a set of flexible radial ratcheting teeth extending radially outwardly from the day disk engagable with recesses on the indexing disk.

A first set of rotationally interengagable lugs is provided between the outer closure member and the indexing disk. A second set of axially interengagable lugs are provided between the indexing disk and the inner closure member. The day disk has circumferentially spaced indicia thereon and the base wall of the outer closure member has an opening adapted to be selectively aligned with the indicia.

Interengaging threads are provided on the inner closure member adapted to engage threads on a container by relative rotation of the inner closure member. When the outer closure member is moved axially to engage the inner closure member, the closure can be removed from a container. The day disk can be rotated relative to the outer closure member in one mode during application and in another mode during removal of closure to bring different indicia into view through the opening.

U.S. Pat. No. 7,857,134 ('134 Patent), issued to Koch, discloses a Bottle Comprising a Temporal Indicator. The Koch '134 Patent describes A bottle system includes a bottle having first tabs disposed on exterior sidewalls thereof and a cap assembly. The cap assembly includes a securing member including second tabs for cooperating with the first tabs to selectively secure the cap assembly to the bottle and an indicator member disposed between the securing member and the bottle having a sidewall visible through the securing member.

As may be understood from a consideration of the foregoing, the prior art has shown a number of indicator or indexing cap assemblies for indicating (or reminding) users as to how many times the container has been entered for the purpose of more effectively consuming doses administered from the container. It will be further understood, however, from a review of the foregoing, and the field of indicating cap assembly art in general that the prior art perceives a need for an indexing cap assembly substantially as summarized hereinafter.

SUMMARY OF THE INVENTION

The present invention relates to a bottle cap that indexes visual cues or indicia during an open and close cycle. More particularly, the cap or cover construction according to the present invention comprises a window that indicates a combination of day (Monday through Sunday) and times per day (e.g. 1 to 3) information. Every cycle of opening and closing of the cap assembly relative to the container, the index (a combination of Day and Times) will be advanced once.

A primary benefit of the subject invention is to provide or enable seniors or old patients to know if they have taken the medicine or not for the day and the number of times. Further, the cap as designed can be assembled with bottles having various ways of closing, such as rotating, push and rotating, etc. To achieve these and other readily apparent objectives, the present invention essentially provides a bottle and a cap system that can tell the senior or old patients if they have taken the pills for the day and number of times of the day.

Each time the indexing cap completes a cycle of opening and closing, the day and times will be updated to a new combination of day and times. The indexing cap assembly according to the present invention generally comprises six components, including a cover construction, an indexing plate or wheel, a compression coil or spring, a push plate construction, a gear tray or swing plate construction, and an assembly ring. The cover construction and assembly ring are joined together to essentially form or close the cap assembly with the other parts coaxially aligned and operable therebetween.

The indexing wheel is rotatively received within the cover construction such that axial displacements of the push plate advance the indexing wheel and indicia upon its upper surface are sequentially revealed by way of the window formed in the cover construction. The indexing wheel can only rotate with respect to the cover construction. The indexing wheel preferably comprises wheel gears that face downward and either a gear tray or swing plate construction comprise gear-engagable structure for meshing with the wheel gears and advancing the same.

In a first embodiment according to the present invention the cover construction and indexing wheel each comprise a series of gears corresponding to the number of visual cues observable through the window formed in the cover. A push plate and swing plate combination converts axially directed forces into rotational forces for advancing the indexing wheel relative to the cover construction.

The indexing wheel comprises spring based fingers that enable the wheel to step advance and the swing plate comprises a spring based finger for drive advancing the indexing wheel. The push plate and swing plate force conversion means is structured so as to convert the axial displacements into rotative displacements equal to the gear displacements. The swing plate is contained between the indexing wheel and the push plate. The push plate can only move up and down relative to the cover construction in alignment with its axis.

During the closure event of placing the indexing cap assembly onto the bottle or container, the container rim forces the push plate in an upward direction, thereby converting axially directed force into rotative force for driving the swing plate into the gearing of the indexing plate, and the indexing plate step-advances a certain angular degree of rotation to advance the next visual cue into the window.

During an opening event of removing the indexing cap assembly from the bottle or container, the container rim is axially displaced away from the indexing cap. This causes the push plate to move down under the force of the spring. After a specific distance or axial displacement, the push plate and swing plate force conversion means are structured so as to convert the axial displacements into rotative displacements equal to the gear displacements for resetting the swing plate finger to re-advance the indexing wheel during the next closure event. This rotation of the indexing wheel will keep the same combination of day and times per day indicia circulating through the index window.

In another embodiment according to the present invention a push plate has two sets of gear teeth (6 teeth for each set), one set of gear teeth are facing upward so as to mesh with the gear teeth of the indexing plate, and the other set of gear teeth face downward to mesh with the gear teeth of the gear tray. The push plate is contained between the indexing wheel and the gear tray, and is held by a series of slots formed at the inner top of the cover construction. The push plate can only move up and down relative to the cover construction in alignment with its axis.

During the closure event of placing the indexing cap assembly onto the bottle or container, the container rim forces the push plate in an upward direction, thereby meshing the gear teeth of the push plate with the gear teeth of the indexing wheel. The angles of these gear teeth are designed in such a way that the indexing wheel will rotate 1/42 of a circle when the push plate completes its upward motion. This rotation of the indexing wheel will advance the combination of day and times per day indicia through the index window.

During an opening event of removing the indexing cap assembly from the bottle or container, the container rim is axially displaced away from the indexing cap. This causes the push plate to move down under the force of the spring. After a specific distance or axial displacement, the gear teeth of the push plate will start to mesh with the gear teeth of the gear tray, which will rotate the indexing wheel 1/42 of a circle when the push plate completes its downward motion. This rotation of the indexing wheel will keep the same combination of day and times per day indicia circulating through the index window.

BRIEF DESCRIPTION OF THE DRAWINGS

Other features of our invention will become more evident from a consideration of the following brief descriptions of illustrations of the subject invention.

DETAILED DESCRIPTION OF THE PREFERRED EMBODIMENT

Figure 1:
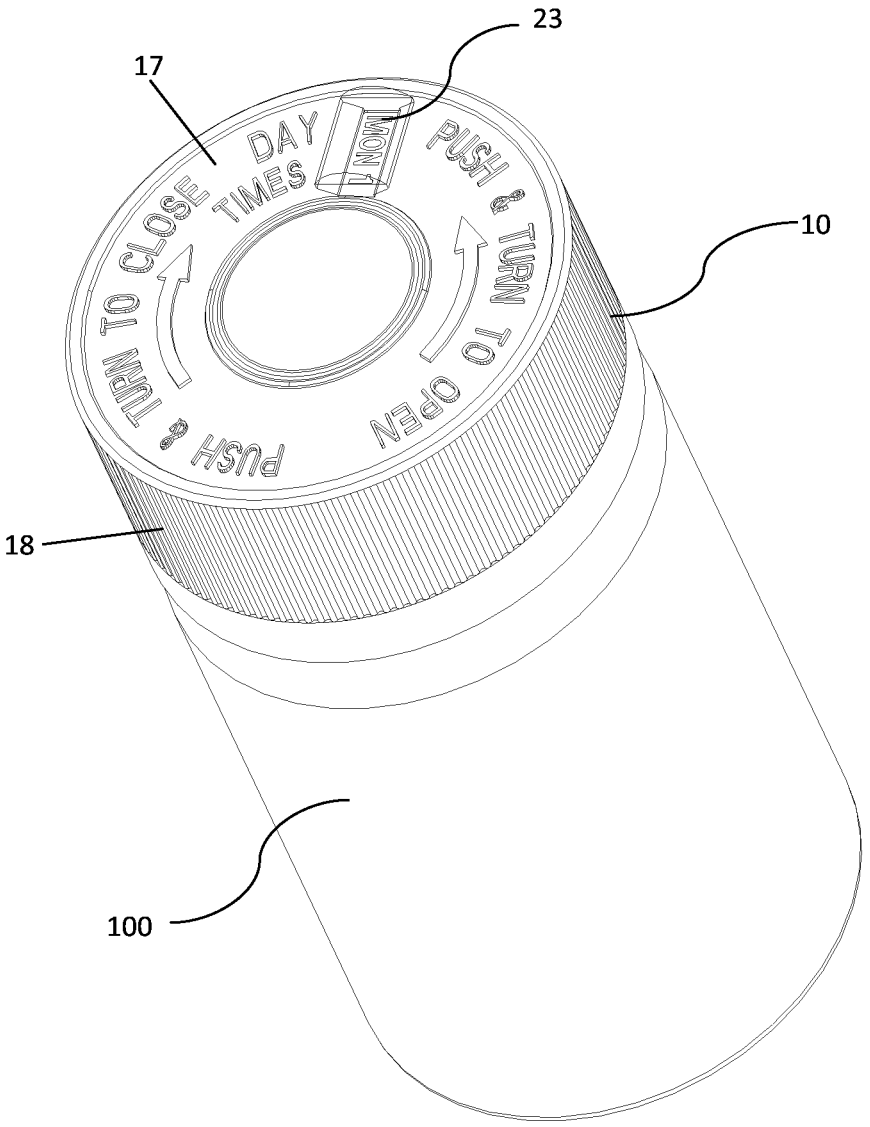
FIG. 1 is a top perspective view of a preferred embodiment of the indexing cap assembly according to the present invention attached to a container.

Referring now to the drawings with more specificity, the present invention preferably provides an indexing cap assembly (as at 10) for use in combination with a container construction (as at 100) to track entry into the container 100 so that users may be provided with cap-based visual cues or indicia effectively alerting or reminding them as to how many times the container 100 has been opened.

The container 100 necessarily comprises certain structure cooperable with the cap assembly according to the present invention, and in this regard, preferably comprises an upwardly extending container rim as at 101, and a series or radially outward, mouth-based or rim-based cap-engaging structures or cap retention means as preferably exemplified by hooks or lugs as at 102, but as alternatively exemplified by threads (not specifically illustrated).

The indexing cap assembly 10 according to the present invention preferably comprises a number of components, including a circular cover construction as at 11; an annular indexing wheel as at 12; a compression coil spring member as at 13; an annular swing plate construction as at 14; a push plate construction as at 15; and an annular assembly ring as at 16. The components 11-16 are all axially alignable about an indexing cap assembly axis generally referenced at 110. In this regard, each component 11-16 comprises its own axis, which when in assembled relation is coaxial with the assembly axis 110.

Accordingly, the circular cover construction 11 preferably comprises a cover axis as at 111 (in coaxial alignment with cap assembly axis 110 in FIGS. 2 and 3), a planar upper cover portion as at 17, a cover skirt as at 18, a series of assembly ring hooks as at 19, a series of cover gears as at 20, a cover hub as at 21, and a series of plate flange hooks as at 22. The upper cover portion 17 preferably comprises an indicator window as at 23.

The cover skirt 18 extends axially downward from the upper cover portion 17 at a first cover radius from the cover axis 111 and terminates at a skirt terminus 24. The indicator window 23 radially extends from the cover axis 111 toward the cover skirt 18. The assembly ring hooks 19 extend radially inward from the cover skirt 18 adjacent the skirt terminus 24.

The cover gears 20 extend radially inward from the cover skirt 18 adjacent the upper cover portion 17. The cover hub 21 comprising a hub slot as at 25, and extends axially downward from the upper cover portion 17 at a second cover radius from the cover axis 111. The plate flange hooks 22 extend axially downward (and outward) from the upper cover portion 17 at a third cover radius from the cover axis 111, which third cover radius is intermediate the first and second cover radii.

The cover construction 11 may further preferably comprise certain spoke-receiving slots as at 26. The spoke-receiving slots 26 are formed at an inner cover diameter. It is contemplated that both the spoke-receiving slots 26 and the assembly ring hooks 19 may essentially function to receive and support certain ring spokes 27 formed on the annular assembly ring 16 for enhancing the final assemblage of the indexing cap assembly 10.

From a consideration of the assembly ring 16 construction, it will be seen that the ring spokes 27 essentially define circumferentially spaced spoke spaces as at 28. In other words, between the ring spokes 27 are gaps or spoke spaces 28. In this regard, the cover construction 11 may further preferably comprise a series of circumferentially spaced spoke gap filler structures as at 29. The spoke gap filler structures 29 being receivable in the spoke spaces 28 for preventing rotation of the assembly ring 16 relative to the cover construction 11 about the cap assembly axis 110.

The annular, day disk type indexing wheel 12 preferably comprises a wheel axis as at 112 (in coaxial alignment with cap assembly axis 110 in FIGS. 2 and 3); a planar wheel portion as at 30; an inner wheel skirt as at 31; an outer wheel skirt as at 32; a series of wheel gears as at 33; and opposed wheel spring fingers as at 34. The inner wheel skirt 31 and the outer wheel skirt 32 both extend axially downward from the planar wheel portion 30 at respective first and second wheel radii from the wheel axis 112.

Figure 2:
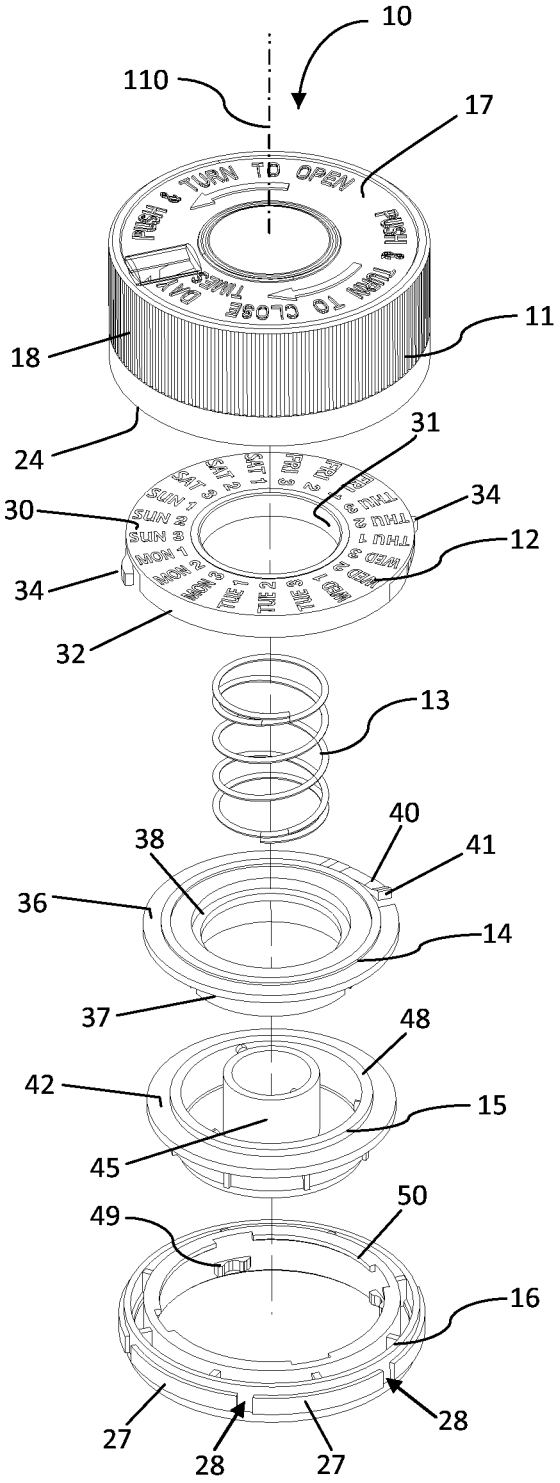
FIG. 2 is a top exploded perspective view of a preferred embodiment of the indexing cap assembly according to the present invention.
Figure 3:
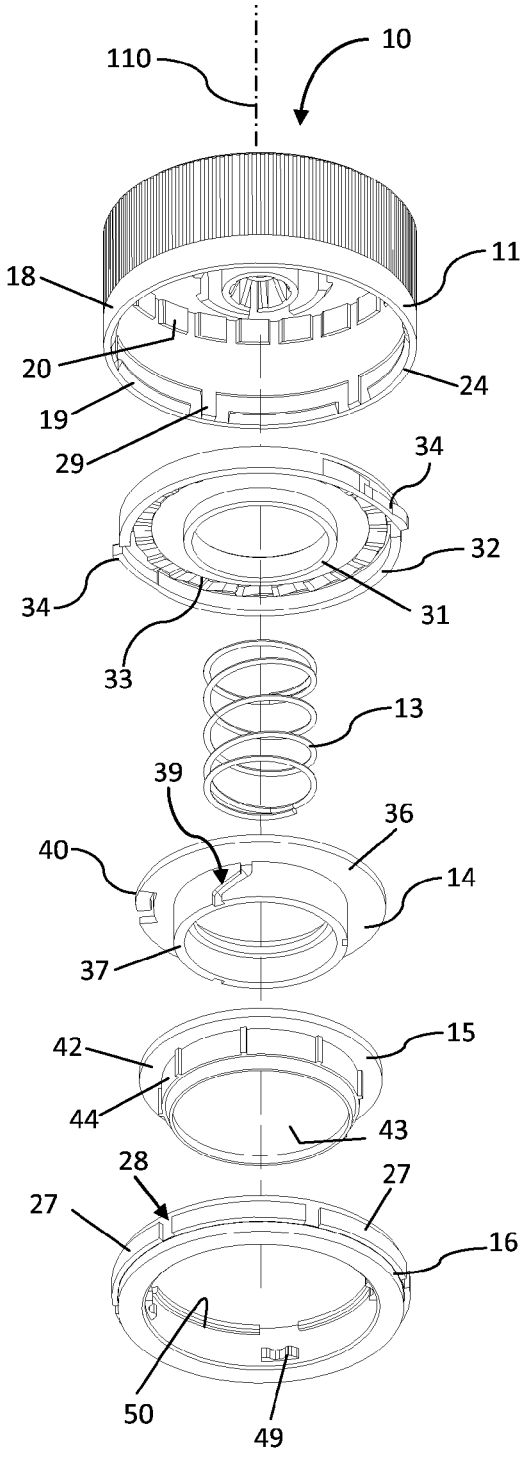
FIG. 3 is a bottom exploded perspective view of a preferred embodiment of the indexing cap assembly according to the present invention.
Figure 4:
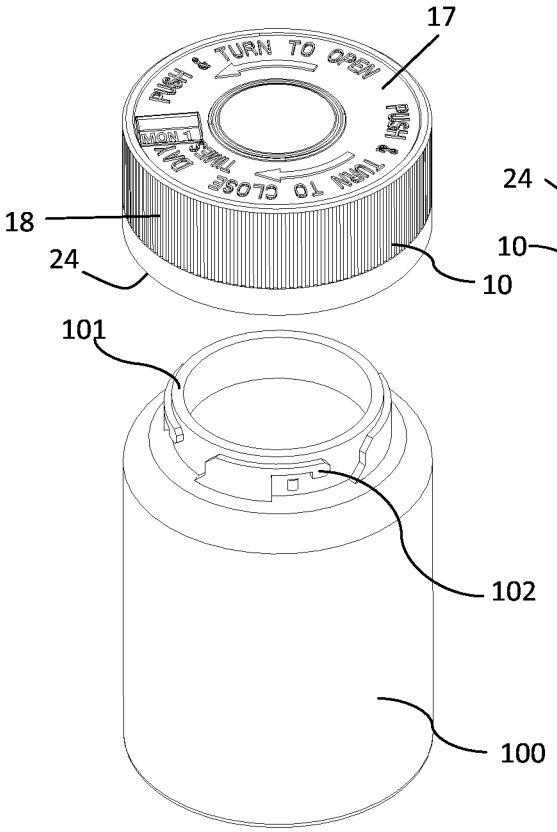
FIG. 4 is a top perspective view of the preferred indexing cap assembly according to the present invention exploded from a container.
Figure 5:
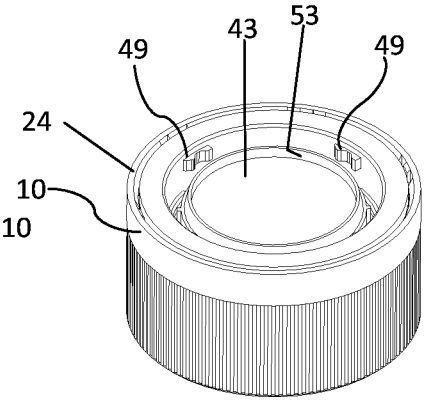
FIG. 5 is a bottom perspective view of the preferred indexing cap assembly according to the present invention.
Figure 6:
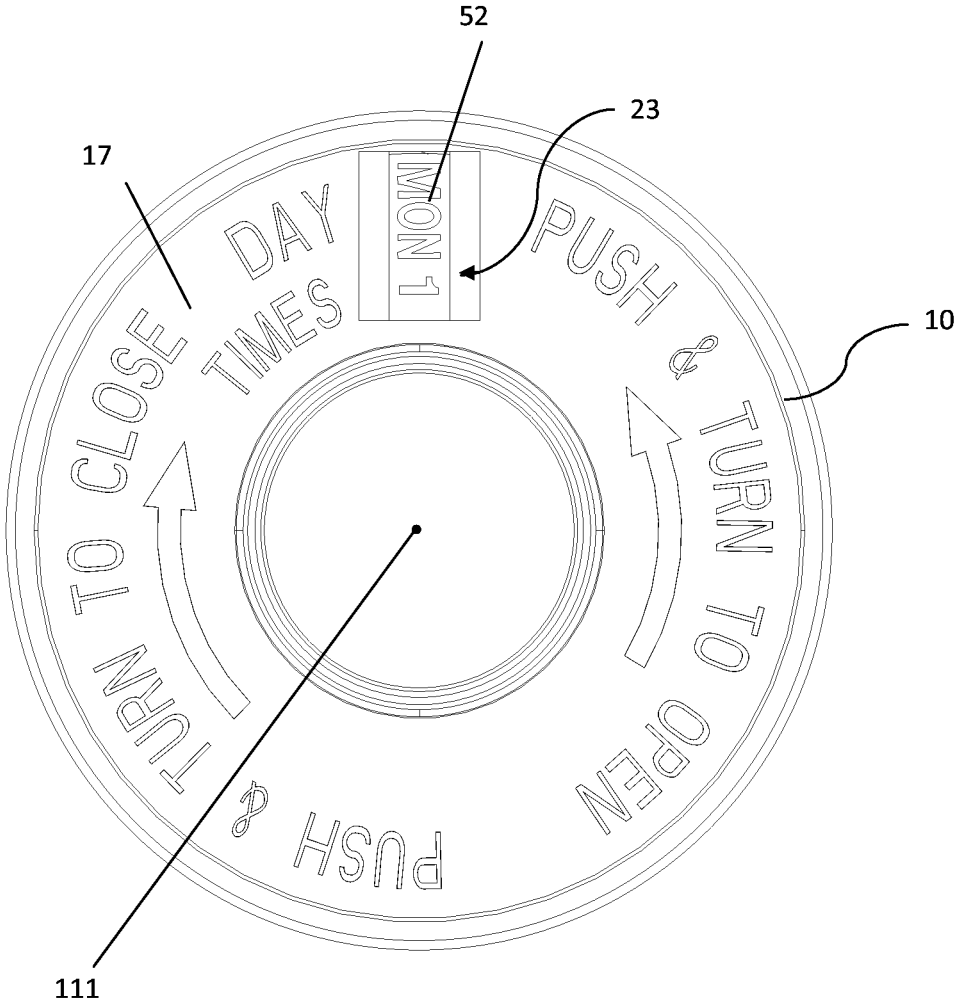
FIG. 6 is a top plan view of the preferred indexing cap assembly according to the present invention.
Figure 7:
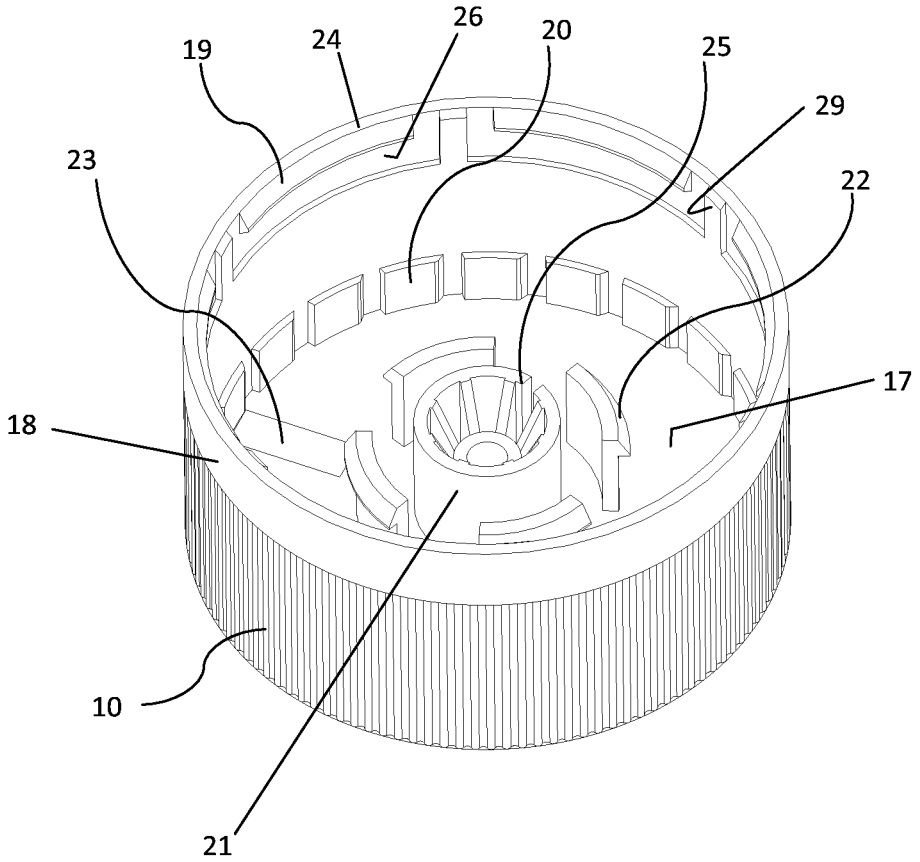
FIG. 7 is a bottom perspective view of a cover construction component of the preferred indexing cap assembly according to the present invention.
Figure 8:
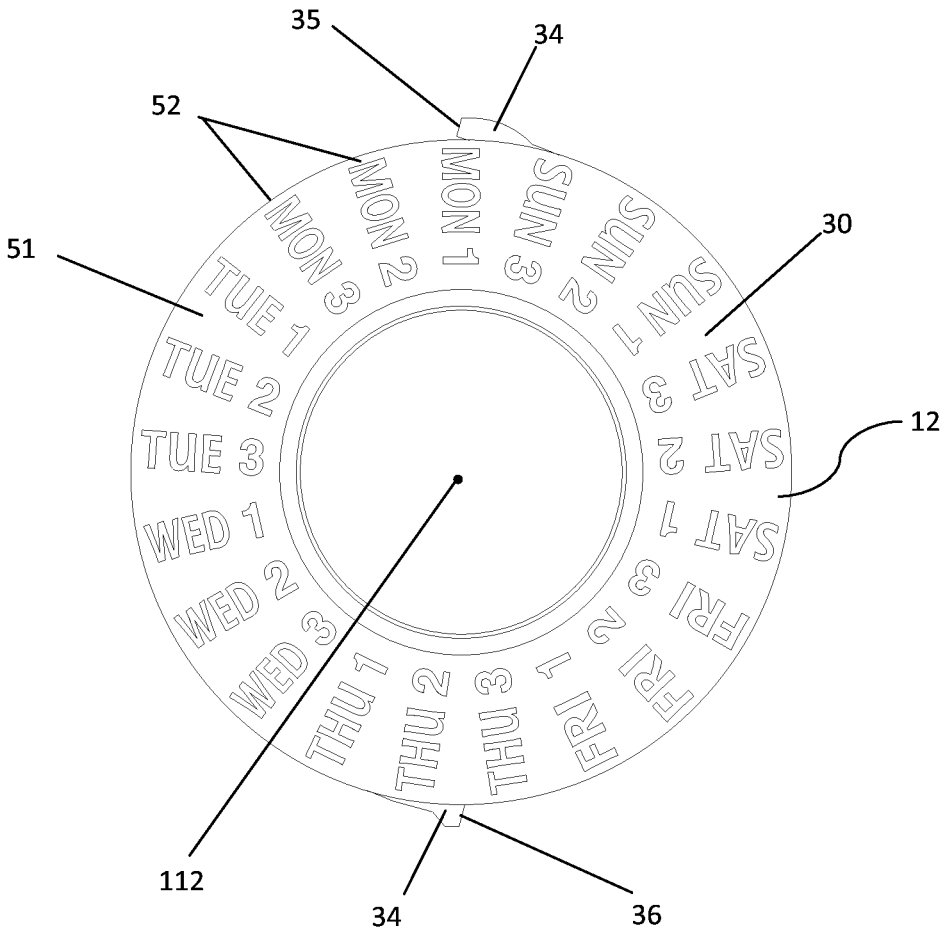
FIG. 8 is a top plan view of an indexing wheel component of the preferred indexing cap assembly according to the present invention.
Figure 9:
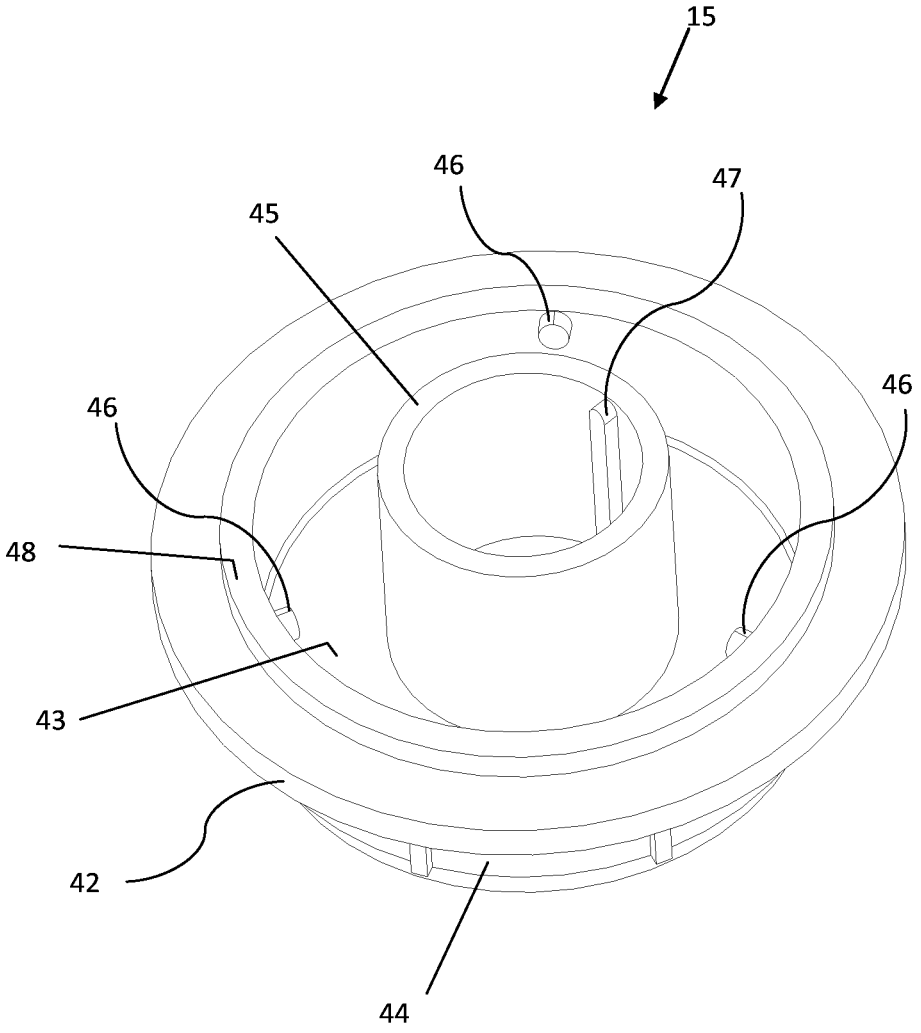
FIG. 9 is a top perspective view of a push plate construction component of the preferred indexing cap assembly according to the present invention.

The wheel gears 33 extend downwardly from the planar wheel portion 30 adjacent the outer skirt 32. The wheel spring fingers 34 extend radially outwardly from the outer wheel skirt 32 and comprise wheel finger termini as at 35. The wheel spring fingers 34 are preferably radially biasable intermediate a wheel finger biased position and a wheel finger relaxed position. The wheel finger termini 35 are essentially at the second wheel radius when in the biased wheel finger position and enmeshable with the cover gears 20 when in the relaxed wheel finger position. The relaxed wheel finger position is generally depicted in FIGS. 2, 3, and 8.

The planar wheel portion 30 of the annular indexing wheel 12 further preferably comprises an upper surface as at 51, which upper surface 51 preferably comprises a series of radially-extending indicia as at 52. The radial extending indicia are preferably sized and shaped for visual inspection via the indicator window 23. In this regard, the indicia 52 are preferably sized top to bottom so as to be cooperable with the angular rotational degree setting as dependent upon the number of cover gears 20 or wheel gears 33 as divided into 360 rotational degrees. The indicia 52 are of sufficient radial length to fit within the radial length of the window 23.

The compression coil spring member 13 preferably has a spring axis (in coaxial alignment with cap assembly axis 110 in FIGS. 2 and 3) and a substantially uniform spring radius as may be seen from an inspection of the illustrations in this specification. The compression coil spring member 13 essentially provides axially directed spring restorative forces to the cap assembly 10 for re-setting certain gear configurations when the user removes the cap assembly 10 from the container 100, as discussed in more detail later in this specification.

The annular swing plate construction as at 14 preferably comprises a swing plate axis (in coaxial alignment with cap assembly axis 110 in FIGS. 2 and 3); a planar swing plate portion as at 36; a swing plate skirt as at 37; an inner skirt flange as at 38; a series of angled slots as at 39; and a plate spring finger as at 40. The swing plate skirt 37 extends axially downward from the planar swing plate portion 36 at a first plate radius from the plate axis.

The angled slots 39 are formed in a radially outer surface of the swing plate skirt 37. The swing plate finger 40 has a swing plate finger terminus as at 41, and extends upwardly from the swing plate portion 36 at a second plate radius. The swing plate spring finger 40 is biasable intermediate a plate finger biased position and a plate finger relaxed position. The plate finger terminus 41 essentially becomes coplanar with the swing plate portion 36 when in the biased swing plate finger position and enmeshable with the wheel gears 33 when in the relaxed swing plate finger position. The relaxed swing plate finger position is generally depicted in FIG. 2.

The push plate construction 15 preferably comprises a push plate axis (in coaxial alignment with cap assembly axis 110 in FIGS. 2 and 3); an annular push plate portion as at 42; a planar push plate portion as at 43; a push plate skirt as at 44; a push plate hub as at 45; a series of push plate posts as at 46; and a push plate rib as at 47. The push plate skirt 44 extends axially upwardly from the planar push plate portion 43 at a first push plate radius from the push plate axis.

The push plate skirt 44 comprises an upper push plate skirt terminus as at 48. The annular push plate portion 42 extends radially outward from the push plate skirt 44. The push plate hub 45 also extends axially upwardly from the planar push plate portion 43 at a second push plate radius from the push plate axis radially inward of the push plate skirt 44. The push plate posts 46 extend radially inward from the push plate skirt 44 adjacent the push plate skirt terminus 48 for meshing with the angled slots 39 of the annular swing plate construction 14. The push plate rib 47 extends radially inward from the push plate hub 45 for meshing with the hub slot 25 of the cover construction 11.

The push plate construction 15 may further preferably comprise a container-aligning skirt as at 53. The container-aligning skirt 53 extends axially downward from the planar push plate portion 43 at a third push plate radius from the push plate axis. The container-aligning skirt 53 preferably has a skirt radius that is mechanically cooperable with the container rim radius for enhancing proper alignment of the indexing cap assembly 10 relative to the container 100 when attaching the indexing cap assembly 10 to the container 100.

More particularly, the container rim 101 preferably comprises a certain container rim diameter and the container-aligning skirt 53 preferably comprises a skirt diameter, whereby the skirt diameter is lesser in magnitude than the container diameter for being received radially inwardly of the container rim 101 when attaching the indexing cap assembly 10 to the container 100.

The annular assembly ring 16 preferably comprises a ring axis (in coaxial alignment with cap assembly axis 110 in FIGS. 2 and 3); an inner ring diameter; an outer ring diameter; a series of container-engaging ring posts as at 49; a series of push plate-engaging ring flanges as at 50; and a series of container-engaging ring spokes as at 27.

The container-engaging ring posts 49 preferably extend radially inward from the inner ring diameter of the assembly ring 16 for meshing with container mouth-based hooks 102. The push plate-engaging ring flanges 50 preferably extend radially inward from the inner ring diameter for estopping the annular push plate portion 42, and the container-engaging ring spokes 27 preferably extend radially outward from the outer ring diameter for meshing with the assembly ring hooks 19 and spoke-receiving slots 26.

Figure 10:
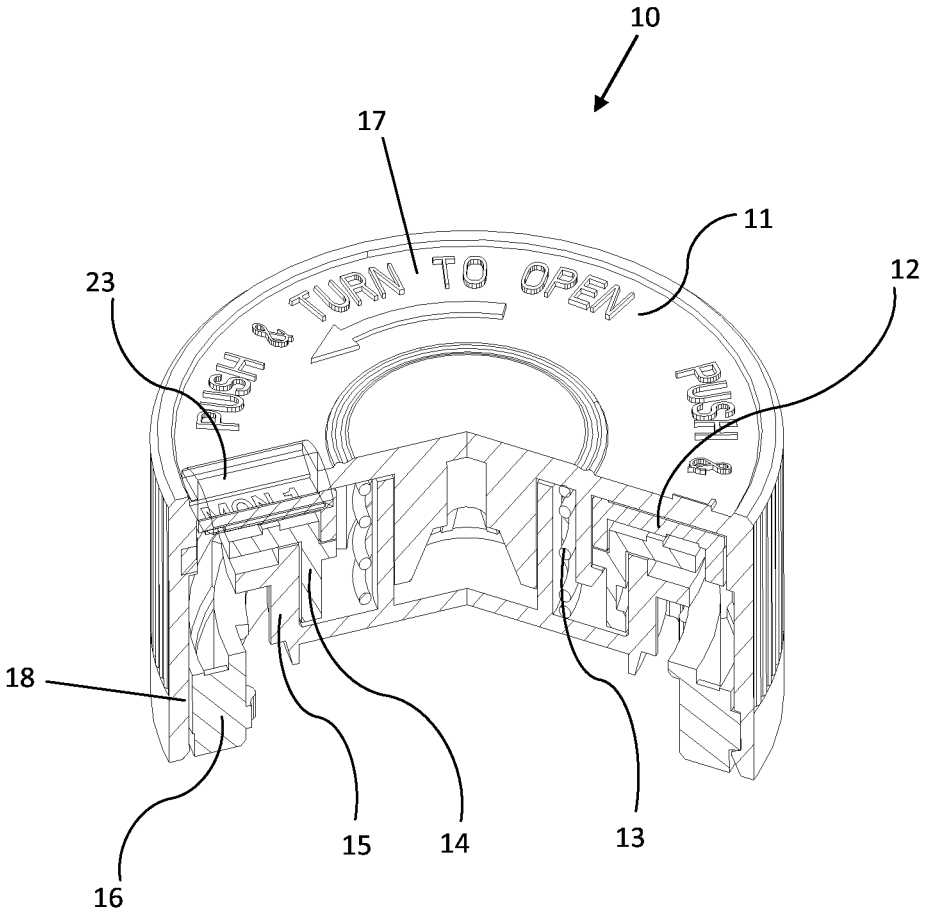
FIG. 10 is a fragmentary top perspective view of the preferred indexing cap assembly according to the present invention with parts sectioned away to depict relative structural orientations of the various components otherwise hidden from view when fully assembled.
Figure 11:
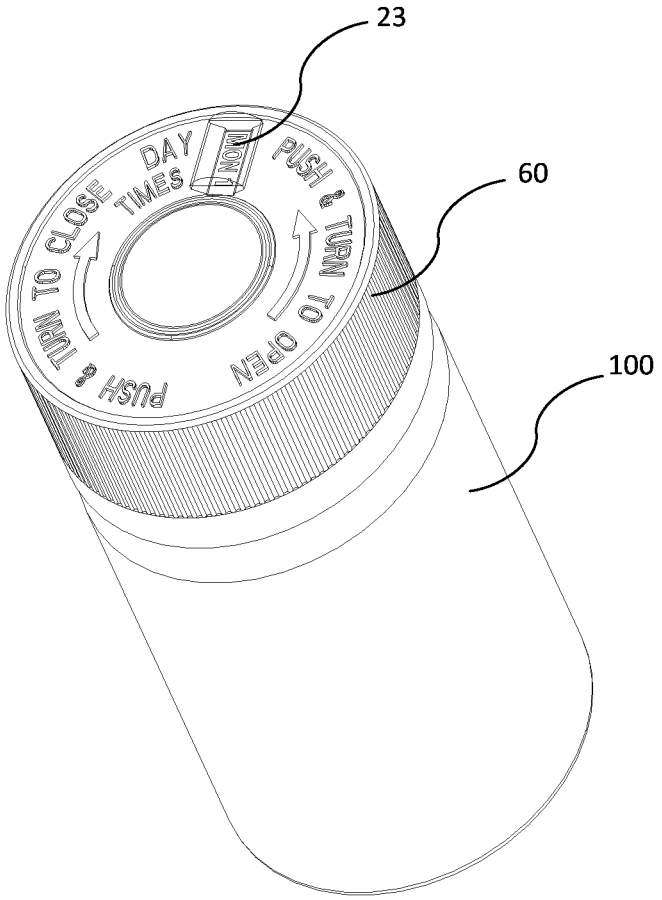
FIG. 11 is a top perspective view of an alternative embodiment of the indexing cap assembly according to the present invention attached to a container.
Figure 12:
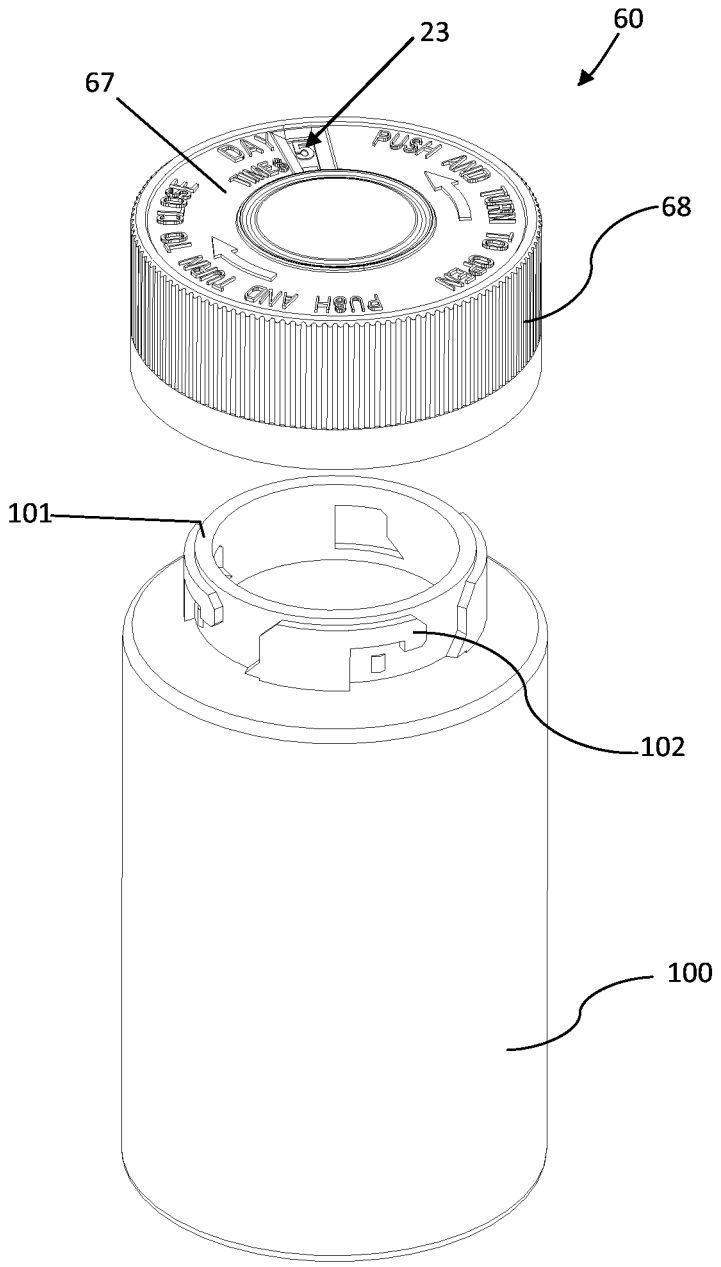
FIG. 12 is a top perspective view of the alternative indexing cap assembly according to the present invention exploded from a container.
Figure 13:
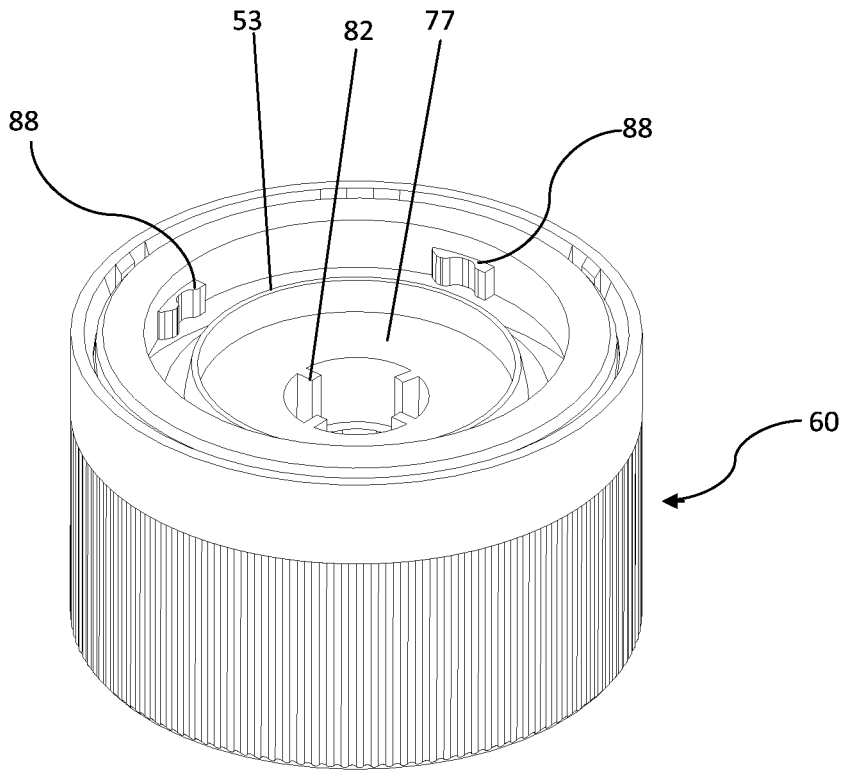
FIG. 13 is a bottom perspective view of the alternative indexing cap assembly according to the present invention.
Figure 14:
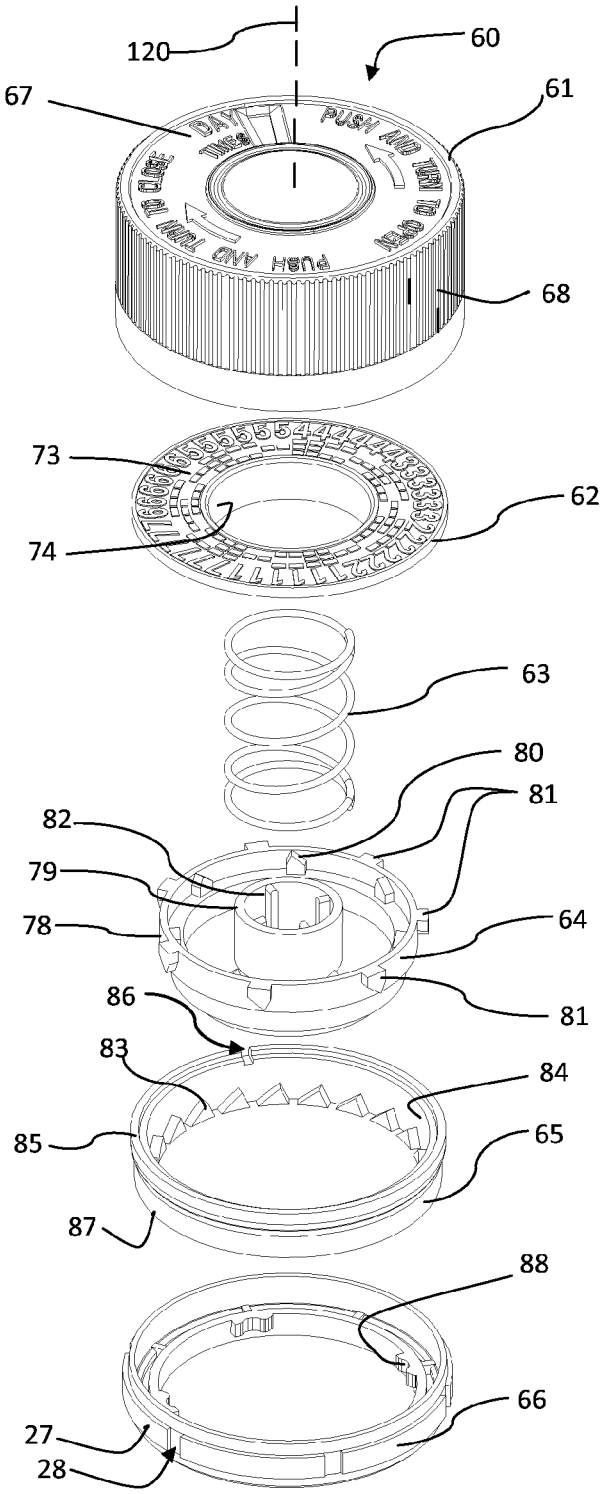
FIG. 14 is a top exploded perspective view of the alternative embodiment of the indexing cap assembly according to the present invention.
Figure 15:
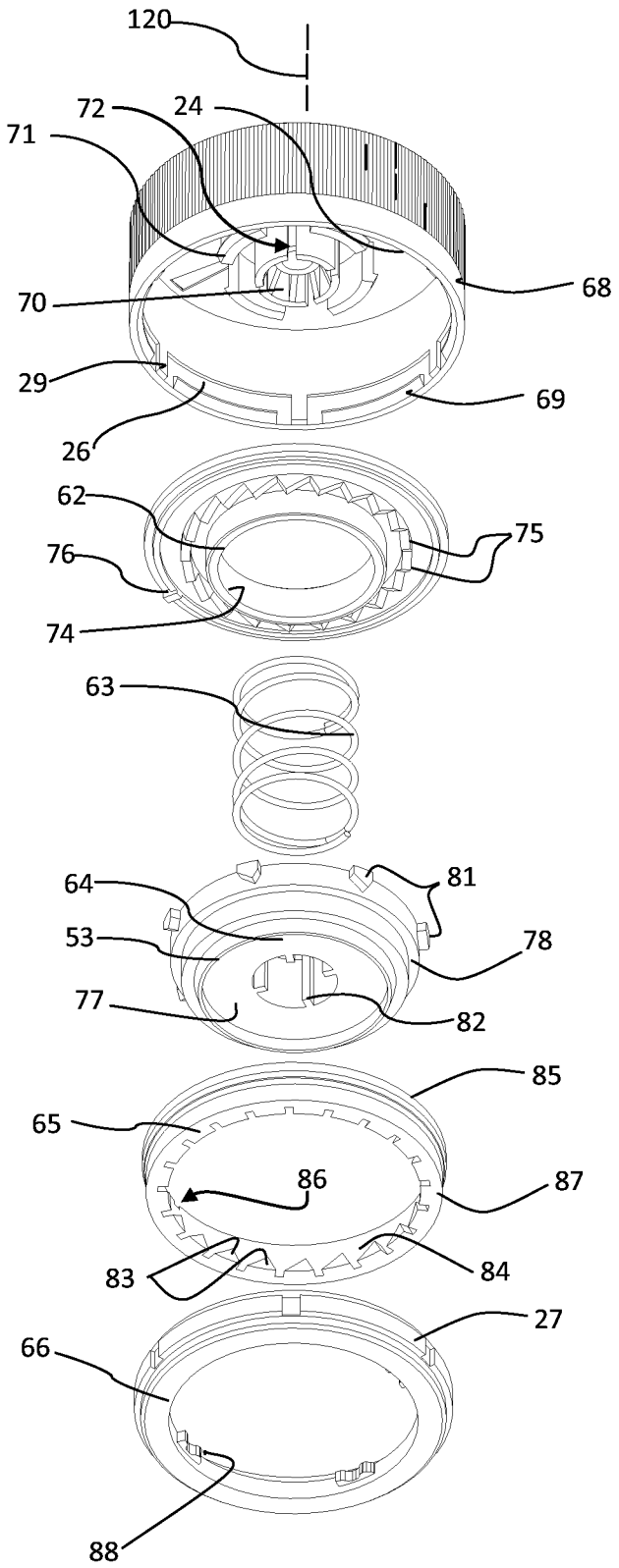
FIG. 15 is a bottom exploded perspective view of the alternative embodiment of the indexing cap assembly according to the present invention.
Figure 16:
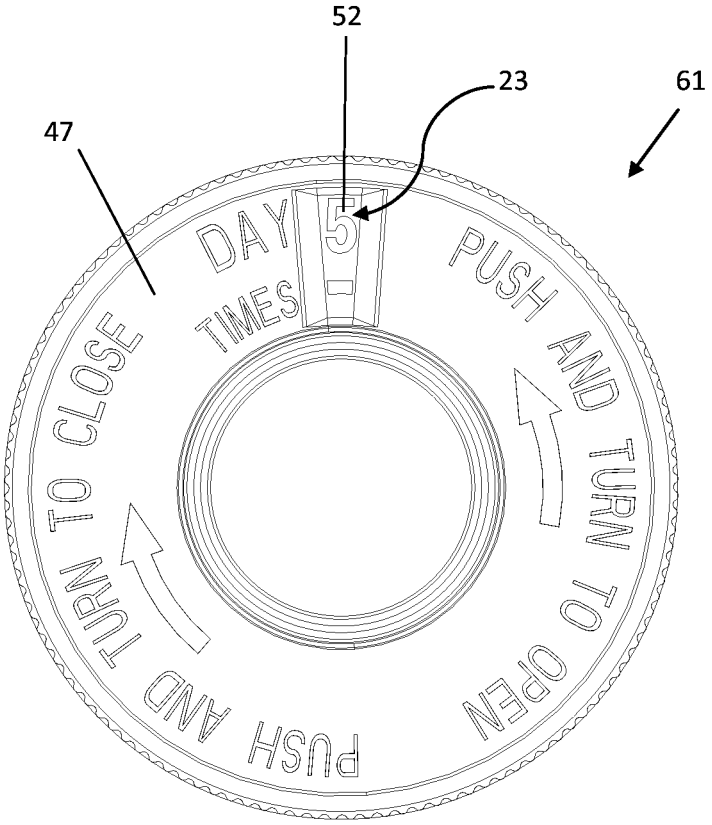
FIG. 16 is a top plan view of the alternative indexing cap assembly according to the present invention.
Figure 17:
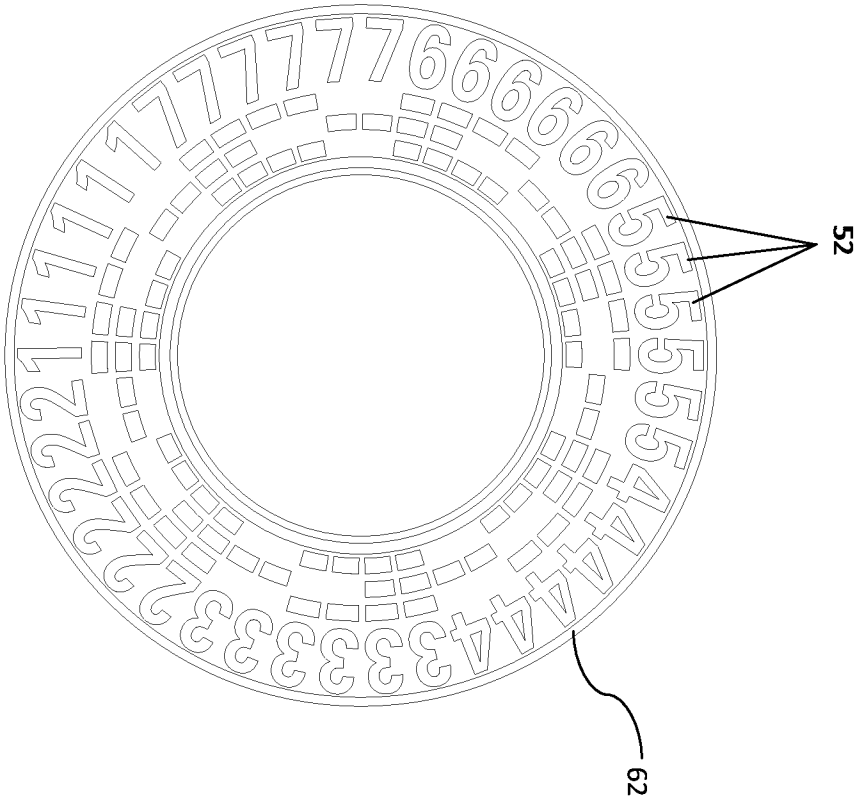
FIG. 17 is a top plan view of an indexing wheel component of the alternative indexing cap assembly according to the present invention.

From a consideration of the illustrations generally, and from a consideration of FIG. 10 particularly, the reader will see that the annular indexing wheel 12 is rotatively received radially intermediate the cover gears 20 and the downwardly axially extending portions of the plate flange hooks 22. The wheel fingers 34 mesh with the cover gears 20 when in the relaxed wheel finger position. The wheel finger termini 35 and cover gears 20 essentially function to cooperably step-advance (i.e. the rotational movement is in the direction opposite the termini 35) the annular indexing wheel 12 relative to the cover construction 11 an angular rotational degree equal to 360 degrees divided by a number of cover gears 20 (e.g. twenty-one cover gears 20 are shown in the illustrations, and the angular rotational degree is thus roughly 17.14 rotational degrees).

The plate flange hooks 22 of the cover construction 11 receive and hook-support the inner skirt flange 38 of the annular swing plate 14 thereby supporting and rotatively mounting the annular indexing wheel 12 to the cover construction 11. The swing plate finger 40 meshes with the wheel gears 33 when in the relaxed swing plate finger position. Together, the plate finger terminus 41 and the wheel gears 33 cooperably drive-advance (i.e. the rotational movement is in the direction facing the terminus 41) the annular indexing wheel 12 relative to the cover construction 11 said angular rotational degree.

The spring member 13 is supported by an upper surface of the planar push plate portion 43 in radial outer adjacency to the push plate hub 45. The inner diameter of the push plate hub 45 preferably receives the outer diameter of the cover hub 21 such that the push plate rib 47 is received in the hub slot 25, and the push plate posts 46 are received in the angled slots 39 of the swing plate construction 14.

The compression coil spring member 13 is compressed intermediate the planar push plate portion 43 and the underside of the planar upper cover portion 17 of the cover construction 11. The push plate construction 15 is thereby spring-biased and movable up and down intermediate an upper wheel-advancing position and a lower gear-resetting position. The push plate posts 46 of the push plate 15 and the angled slots 39 of the swing plate 14 essentially function to convert axially-directed force(s) into wheel-advancing force (s).

Preferably, the angled slots 39 number three and the push plate posts 46 number three. The preferred number of angled slots 39 and number of push plate posts 46 are preferably circumferentially spaced substantially 120 degrees from one another so as to enhance conversion of axially directed force (s) into rotational wheel-advancing force(s). In other words, it is believed that providing a series of three force-converting cooperable structures as embodied in the posts 46 and slots 39, the cooperable force conversion being circumferentially and equally spaced provides for a more robust and stable operating mechanism.

The assembly ring hooks 19 of the cover construction 11 essentially function to receive and hook-support the ring spokes 27 of the assembly ring 16 for finally assembling the indexing cap assembly 10. The ring flanges 50 essentially function to provide stop structure to the annular push plate portion 42 thereby essentially defining the lower gear-resetting position when the spring member 13 forces the push plate construction 15 in an axial direction away from the planar upper cover portion 17 of the cover construction 11. The plate finger terminus 41 resets at the interface opposite the wheel gears 33 when the push plate construction 15 is in the lower gear-resetting position. The ring posts 49 essentially function to removably attach the indexing cap assembly 10 to the container 100 via the outwardly radiating container mouth hooks 102.

The upwardly extending container rim 101 essentially functions to transmit axially directed force(s) against the planar push plate portion 38 in a first direction so as to displace the same toward the wheel-advancing position when the indexing cap assembly 10 is attached to the container 100, and the spring member 13 essentially functions to transmit axially directed force(s) against the planar push plate portion 38 in a second direction for resetting the indexing cap assembly 10 when detached from the container 100.

Referring now to FIGS. 11-18 with more specificity, the present invention further contemplates an alternative indexing cap assembly (as at 60) for use in combination with the container construction (as at 100), which container may be described by referring to the foregoing specifications. Briefly, the container 100 may preferably comprises certain structure cooperable with the cap assembly 60, namely an upwardly extending container rim 101, and a series or radially outward, mouth-based or rim-based cap-engaging structures as preferably exemplified by hooks 102.

The indexing cap assembly 60 according to the present invention preferably comprises a number of components, including a circular cover construction as at 61; an annular indexing wheel as at 62; a compression coil spring member as at 63; a push plate construction as at 64; an annular gear tray as at 65; and an annular assembly ring as at 66. The components 61-66 are all axially alignable about an indexing cap assembly axis generally referenced at 120. In this regard, each component 61-66 comprises its own axis, which when in assembled relation is coaxial with the assembly axis 120.

Accordingly, the circular cover construction 61 preferably comprises a cover axis (in coaxial alignment with cap assembly axis 120 in FIGS. 14 and 15), a planar upper cover portion as at 67, a cover skirt as at 68, a series of assembly ring hooks as at 69, a cover hub as at 70, and a series of wheel flange hooks as at 71. The cover construction 61 is substantially identical to the cover construction 11 but for the lack of cover gears (as at 20 in construction 11) and a modified cover hub 70.

Accordingly, the upper cover portion 67 preferably comprises an indicator window substantially identical to indicator window 23. The cover skirt 68 extends axially downward from the upper cover portion 67 at a first cover radius from the cover axis and terminates at a skirt terminus as at 24. The indicator window 23 radially extends from the cover axis toward the cover skirt 68. The assembly ring hooks 69 extend radially inward from the cover skirt 68 adjacent the skirt terminus 24.

The cover hub 70 comprises a series of hub slots as at 72, and extends axially downward from the upper cover portion 67 at a second cover radius from the cover axis. The wheel flange hooks 71 extend axially downward (and outward) from the upper cover portion 67 at a third cover radius from the cover axis, which third cover radius is intermediate the first and second cover radii. The cover construction 61 may further preferably comprise spoke-receiving slots 26 formed at an inner cover diameter. It is contemplated that both the spoke-receiving slots 26 and the assembly ring hooks 69 may essentially function to receive and support ring spokes 27 formed on the annular assembly ring 66 for enhancing the final assembly of the indexing cap assembly 60.

From a consideration of the assembly ring 16 construction, it will be seen that the ring spokes 27 essentially define circumferentially spaced spoke spaces as at 28. In other words, between the ring spokes 27 are gaps or spoke spaces 28. In this regard, the cover construction 11 may further preferably comprise a series of circumferentially spaced spoke gap filler structures as at 29. The spoke gap filler structures 29 being receivable in the spoke spaces 28 for preventing rotation of the assembly ring 66 relative to the cover construction 61.

The annular indexing wheel 62 preferably comprises a wheel axis (in coaxial alignment with cap assembly axis 120 in FIGS. 14 and 15); a planar wheel portion as at 73; a wheel skirt as at 74; a series of wheel gears as at 75; and a wheel finger as at 76. The wheel skirt 74 extends axially downward from the planar wheel portion 73 at a first wheel radius from the wheel axis. The wheel gears 75 extend downwardly from the planar wheel portion 73 at a second wheel radius greater than the first wheel radius. The wheel finger 76 extends downwardly from the planar wheel portion 73 and radiates outwardly terminating at the maximum wheel radius. The wheel finger 76 is a fixed projection.

The planar wheel portion 73 of the annular indexing wheel 62 further preferably comprises an upper surface, which upper surface preferably comprises radially-extending indicia 52. The radial extending indicia 52 are preferably sized and shaped for visual inspection via the indicator window 23. In this regard, the indicia 52 are preferably sized top to bottom so as to be cooperable with the angular rotational degree setting as dependent upon the number of wheel gears 75 as divided into 360 rotational degrees. The indicia 52 are of sufficient radial length to fit within the radial length of the window 23.

The compression coil spring member 63 preferably has a spring axis (in coaxial alignment with cap assembly axis 120 in FIGS. 14 and 15) and a substantially uniform spring radius as may be seen from an inspection of the illustrations in this specification. The compression coil spring member 63 essentially provides axially directed spring restorative forces to the cap assembly 60 for re-setting certain gear configurations when the user removes the cap assembly 60 from the container 100.

The push plate construction 64 preferably comprises a push plate axis (in coaxial alignment with cap assembly axis 120 in FIGS. 14 and 15); a planar push plate portion as at 77; a push plate skirt 78; a push plate hub as at 79; a series of inner push plate gears 80; a series of outer push plate gears as at 81; and a series of push plate ribs as at 82. The push plate skirt 78 extends axially upwardly from the planar push plate portion 77.

The push plate hub 79 also extends axially upwardly from the planar push plate portion 77 radially inward of the push plate skirt 78. The gearing of the inner push plate gears 80 extends upwardly radially inwardly adjacent to the push plate skirt 78 for meshing with the wheel gears 75. The gearing of the outer push plate gears 81 extends downwardly radially outwardly adjacent to the push plate skirt 78 for meshing with certain gear tray gears 83 formed on the gear tray 65.

The push plate construction 64 may further preferably comprise a container-aligning skirt 53. The container-aligning skirt 53 extends axially downward from the planar push plate portion 77. The container-aligning skirt 53 preferably has a skirt radius that is mechanically cooperable with the container rim radius for enhancing proper alignment of the indexing cap assembly 60 relative to the container 100 when attaching the indexing cap assembly 60 to the container 100.

The annular gear tray comprises a gear tray axis (in coaxial alignment with cap assembly axis 120 in FIGS. 14 and 15); inner tray diameter or surfacing as at 84, an upper tray rim 85; a bottom tray rim 87; a series of gear tray gears as at 83; and a finger-receiving notch as at 86. The gearing of the gear tray gears extends upwardly radially inwardly to the inner tray diameter or surfacing 84 adjacent to the bottom tray rim 87 for meshing with the outer push plate gears 81 on the push plate construction 64. The finger-receiving notch 86 extends radially through the upper tray rim 85 and is designed to receive the wheel finger 76.

The annular assembly ring 66 preferably comprises a ring axis (in coaxial alignment with cap assembly axis 120 in FIGS. 14 and 15); at least one inner ring diameter; an outer ring diameter; a series of container-engaging ring posts as at 88; and a series of container-engaging ring spokes as at 27. The container-engaging ring posts 88 preferably extend radially inward from a first inner ring diameter for meshing with container mouth-based hooks 102, and the container-engaging ring spokes 27 preferably extend radially outward from the outer ring diameter for meshing with the assembly ring hooks 69 and spoke-receiving slots 26.

Figure 18:
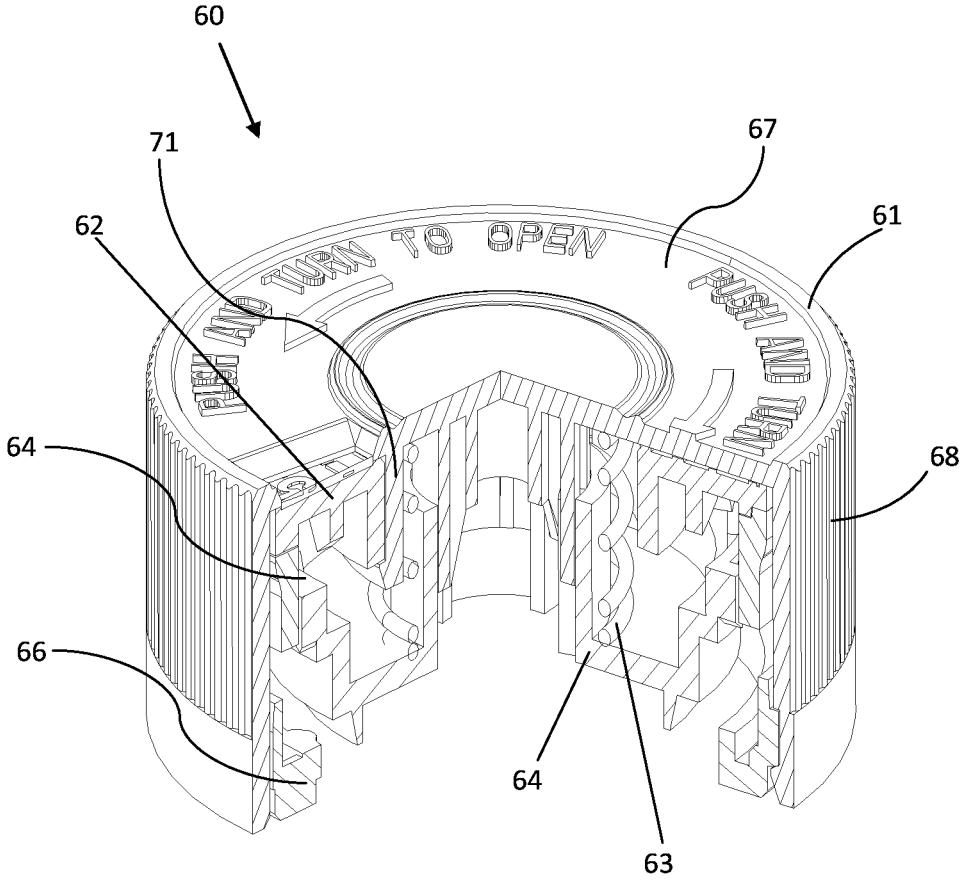
FIG. 18 is a fragmentary top perspective view of the alternative indexing cap assembly according to the present invention with parts sectioned away to depict relative structural orientations of the various components otherwise hidden from view when fully assembled.

From a consideration of the illustrations generally, and from a consideration of FIG. 18 particularly, the reader will see that the annular indexing wheel 62 is rotatively received radially intermediate downwardly axially extending portions of the wheel flange hooks 71 and the cover skirt 68. The wheel flange hooks 71 of the cover construction 61 receive and hook-support the wheel skirt 74 thereby supporting and rotatively mounting the annular indexing wheel 62 to the cover construction 61.

The spring member 63 is supported by an upper surface of the planar push plate portion 77 in radial outer adjacency to the push plate hub 79. The inner diameter of the push plate hub 79 preferably receives the outer diameter of the cover hub 70 such that the push plate ribs 82 are received in the hub slots 72. The spring member 63 is compressed intermediate the planar push plate portion 77 and the underside of the planar upper cover portion 67 of the cover construction 61. The push plate construction 64 is thereby spring-biased and movable up and down intermediate an upper wheel-advancing position and a lower gear-resetting position.

The gearing intermediate the wheel gears 75 of the indexing wheel 62 and the inner push plate push gears 80 of the push plate construction 64 and the gearing intermediate the outer push plate gears 81 of the push plate construction 64 and the gear tray gears 83 of the annular gear tray 65 essentially function to convert axially-directed force(s) into wheel-advancing//wheel-resetting force(s).

The assembly ring hooks 69 of the cover construction 61 essentially function to receive and hook-support the ring spokes 27 of the assembly ring 66 for finally assembling the indexing cap assembly 60, and the ring posts 88 essentially function to removably attach the indexing cap assembly 60 to the container 100 via the outwardly radiating container mouth hooks 102.

The upwardly extending container rim 101 essentially functions to transmit axially directed force(s) against the planar push plate portion 77 in a first direction so as to displace the same toward the wheel-advancing position when the indexing cap assembly 60 is attached to the container 100, and the spring member 63 essentially functions to transmit axially directed force(s) against the planar push plate portion 77 in a second direction for resetting the indexing cap assembly 60 when detached from the container 100.

While the foregoing specifications set forth much specificity, the same should not be construed as setting forth limits to the invention but rather as setting forth certain preferred embodiments and features. For example, it is contemplated that the foregoing specifications support an indexing cap assembly essentially comprising a cover construction, an indexing wheel, a spring member, a push plate, an assembly ring, and certain force conversion means, as exemplified by the cooperable structure engagement of certain push plate constructions with preferred and alternative support structures.

It is believed that the cover construction essentially comprises an upper cover portion, a cover skirt, and a cover hub, wherein the upper cover portion comprises an indicator window. The day disk type indexing wheel essentially comprises an upper wheel portion, a wheel skirt, and a series of wheel gears, the wheel gears extending downwardly from the upper wheel portion. The spring member is preferably a compression coil type spring member having a substantially uniform spring radius.

The push plate essentially comprises planar push plate portion and a push plate hub, the push plate hub extending upwardly from the planar push plate portion. The assembly ring basically comprises certain cover fastening means (e.g. spokes 27) for fastening the assembly ring to the cover construction and certain container fastening means (e.g. posts 49) for fastening the cap assembly to the container.

The force conversion means according to the present invention essentially function to convert axially directed force(s) into rotatively directed force(s). The annular indexing wheel is rotatively received adjacent the cover construction such that the upper wheel portion is viewable via the indicator window. The spring member is supported by the planar push plate portion in radial adjacency to the push plate hub. The spring member is compressible intermediate the planar push plate and upper cover portions.

The push plate thereby becomes spring-biasable and movable intermediate an upper wheel-advancing position and a lower gear-resetting position. The force conversion means function to convert axially-directed forces into wheel-rotating forces. The container fastening means for fastening cap assembly to the cover construction.

The upwardly extending container rim transmits force to the planar push plate portion in a first axial direction for rotatively advancing the indexing wheel a first angular distance via the force conversion means when the indexing cap assembly is attached to the container, and the spring member forces the planar push plate portion in a second axial direction for rotatively advancing the indexing wheel a second angular distance via the force conversion means when the indexing cap assembly is detached from the container.

The force conversion means may be defined by cooperable association between a swing plate as previously specified and the push plate, whereby the swing plate basically comprises angled slots formed in an outer hub surface, and the push plate comprises posts receivable in the slots. Together, the slots and posts function to convert axially directed force into rotatively directed force for rotating the indexing wheel.

Alternatively, the force conversion means may be defined by cooperable association between certain push plate-based gearage (e.g. gears or gear teeth 80 and gears or gear teeth 81) and push plate-opposed gearage (e.g. gears or gear teeth 82 and gears or gear teeth 75). The push plate-based and push plate-opposed gearage also may essentially function to convert axially directed forces into rotatively directed forces for rotating the day disk type indexing wheel.

Accordingly, although the invention has been described by reference to certain preferred and alternative embodiments, it is not intended that the novel arrangements be limited thereby, but that modifications thereof are intended to be included as falling within the broad scope and spirit of the foregoing disclosures and the appended drawings.

We claim:

1. An indexing cap assembly for use with a container construction to track container entry via the cap assembly, the container construction comprising an upwardly extending container rim and a cap retention means for retaining the cap assembly, the indexing cap assembly comprising:

a cover construction, the cover construction comprising an upper cover portion, a cover skirt, a series of assembly ring hooks, a series of cover gears, a cover hub, and a series of plate flange hooks, the upper cover portion comprising an indicator window, the cover skirt extending axially downward from the upper cover portion at a first cover radius and terminating at a skirt terminus, the indicator window radially extending toward the cover skirt, the assembly ring hooks extending radially inward from a cover skirt portion adjacent the skirt terminus, the gears extending radially inward from a cover skirt portion adjacent the upper cover portion, the cover hub comprising a hub slot and extending axially downward from the upper cover portion at a second cover radius, the plate flange hooks extending axially downward from the upper cover portion at a third cover radius intermediate the first and second cover radii;

an annular indexing wheel, the indexing wheel comprising a planar upper wheel portion, an inner wheel skirt, an outer wheel skirt, a series of wheel gears, and opposed wheel spring fingers, the inner and outer wheel skirts extending axially downward from the wheel portion at respective first and second wheel radii, the wheel gears extending downwardly from the wheel portion adjacent the outer skirt, the wheel spring fingers extending radially outwardly from the outer wheel skirt and comprising wheel finger termini, the wheel spring fingers being biasable intermediate a wheel finger biased position and a wheel finger relaxed position, the wheel finger termini being at the second wheel radius when in the biased wheel finger position and meshable with the cover gears when in the relaxed wheel finger position;

a compression coil spring member, the compression coil spring member having a substantially uniform spring radius;

an annular swing plate, the swing plate comprising a planar swing plate portion, a swing plate skirt, an inner skirt flange, a series of angled slots, and a plate spring finger, the plate skirt extending axially downward from the plate portion at a first plate radius, the angled slots being formed in a radially outer surface of the plate skirt, the plate finger having a plate finger terminus, the plate finger extending upwardly from the plate portion at a second plate radius, the plate spring finger being biasable intermediate a plate finger biased position and a plate finger relaxed position, the plate finger terminus being coplanar with the plate portion when in the biased plate finger position and meshable with the wheel gears when in the relaxed plate finger position;

a push plate, the push plate comprising a push plate axis, an annular push plate portion, a planar push plate portion, a push plate skirt, a push plate hub, a series of push plate posts, and a push plate rib, the push plate skirt extending upwardly from the planar push plate portion at a first push plate radius, the push plate skirt comprising a push plate terminus, the annular push plate portion extending radially outward from the push plate skirt, the push plate hub extending upwardly from the planar push plate portion at a second push plate radius, the push plate posts extending radially inward from the push plate skirt adjacent the push plate terminus for meshing with the angled slots, the push plate rib extending radially inward from the push plate hub for meshing with the hub slot;

an annular assembly ring, the assembly ring comprising an inner ring diameter, an outer ring diameter, a series of ring posts, a series of ring flanges, and a series of ring spokes, the ring posts extending radially inward from the inner diameter for meshing with container mouth hooks of a container, the ring flanges extending radially inward from the inner ring diameter for stopping the annular push plate portion, the ring spokes extending radially outward from the outer ring diameter for meshing with the assembly ring hooks;

the annular indexing wheel being rotatively received intermediate the cover gears and the plate flange hooks, the wheel fingers meshing with the cover gears when in the relaxed wheel finger position, the wheel finger termini and cover gears for cooperably step-advancing the annular indexing wheel relative to the cover construction an angular rotational degree equal to 360 degrees divided by a number of cover gears;

the plate flange hooks receiving and hook-supporting the inner skirt flange thereby supporting and rotatively mounting said indexing wheel to said cover construction, the plate finger meshing with the wheel gears when in the relaxed plate finger position, the plate finger terminus and wheel gears for cooperably drive-advancing the indexing wheel relative to the cover construction the angular rotational degree;

the spring member being supported by the planar push plate portion in radial outer adjacency to the push plate hub, the inner diameter of the push plate hub receiving the outer diameter of the cover hub such that the push plate rib is received in the hub slot, the push plate posts are received in the angled slots, and the spring member is compressed intermediate the planar push plate and upper cover portions, the push plate thereby being spring-biased and movable up and down intermediate an upper wheel-advancing position and a lower gear-resetting position, the push plate posts and angled slots for converting axially-directed force into wheel-advancing force;

the assembly ring hooks receiving and hook-supporting the ring spokes of the assembly ring thereby finally assembling the cap assembly, the ring flanges for providing stop structure to the annular push plate portion thereby defining the lower gear-resetting position when the spring member forces the push plate construction in an axial direction away from the upper cover portion, the plate finger terminus resetting at the wheel gear interface when the push plate construction is in the lower gear-resetting position, the ring posts for removably attaching the cap assembly to the container via the cap retention means, the upwardly extending container rim for forcing the planar push plate portion toward the wheel-advancing position when the cap assembly is attached to the container, the spring member for forcing the planar push plate portion toward the gear-resetting position when the cap assembly is detached from the container.

2. The indexing cap assembly of claim 1, wherein the upper wheel portion comprises an upper surface, the upper surface comprising a series of radially-extending indicia, the radially-extending indicia being sized and shaped for visual inspection via the indicator window.

3. The indexing cap assembly of claim 1, wherein the angled slots number three and the push plate posts number three, the angled slots being circumferentially spaced substantially 120 degrees from the push plate posts so as to enhance conversion of axially directed force into rotatively directed force.

4. The indexing cap assembly of claim 1, wherein the push plate comprises a container-aligning skirt, the container-aligning skirt extending axially downward from the planar push plate portion, the container-aligning skirt having a skirt radius cooperable with a container rim radius for locating and enhancing proper alignment of the cap assembly relative to the container when attaching the cap assembly to the container.

5. The indexing cap assembly of claim 4, wherein the skirt radius is lesser in magnitude than the container rim radius being received radially inwardly of the container rim when attaching the cap assembly to the container.

6. The indexing cap assembly of claim 1, wherein the cover construction comprises spoke-receiving slots at an inner cover diameter, both the spoke-receiving slots and the assembly ring hooks for receiving and supporting the ring spokes for enhancing the cap assembly.

7. The indexing cap assembly of claim 6, wherein the ring spokes define circumferentially spaced spoke spaces and the cover construction comprises a series of circumferentially spaced spoke gap filler structures, the spoke gap filler structures being receivable in the spoke spaces for preventing rotation of the assembly ring relative to the cover construction.

8. An indexing cap assembly for mounting to a container to track container entry via the cap assembly, the container comprising a cap retention means and an upwardly extending container rim, the indexing cap assembly comprising:

a cover construction, the cover construction comprising an upper cover portion, a cover skirt, a series of cover gears, and a cover hub, the upper cover portion comprising an indicator window, the cover gears extending radially inward from a cover skirt portion adjacent the upper cover portion;

an indexing wheel, the indexing wheel comprising, an upper wheel portion, an outer wheel skirt, a series of wheel gears, and at least one wheel spring finger, the wheel gears extending downwardly from the upper wheel portion, each wheel spring finger extending radially outwardly from the outer wheel skirt, each wheel spring finger being biasable intermediate a wheel finger biased position and a wheel finger relaxed position;

a spring member, the spring member having a substantially uniform spring radius;

an annular swing plate, the swing plate comprising a swing plate planar portion, a swing plate skirt, an inner skirt flange, at least one angled slot, and a spring plate finger, each angled slot being formed in a radially outer surface of the plate skirt, the swing plate finger extending upwardly from the swing plate planar portion and being biasable intermediate a plate finger biased position and a plate finger relaxed position;

a push plate, the push plate comprising a planar push plate portion, a push plate skirt, a push plate hub, and at least one push plate post, the push plate hub extending upwardly from the planar push plate portion, each push plate post extending radially inward from the push plate skirt for meshing with a select angled slot; and an assembly ring, the assembly ring comprising at least one ring flange, a cover fastening means for fastening the assembly ring to the cover construction, and a container fastening means for fastening the cap assembly to the container, each ring flange extending radially inward for stopping the planar push plate portion, the annular indexing wheel being rotatively received adjacent the cover gears, the wheel finger meshing with the cover gears when in the relaxed wheel finger position, the wheel finger and the cover gears for cooperably step-advancing the indexing wheel relative to the cover construction an angular rotational degree equal to 360 degrees divided by a number of cover gears, the plate finger meshing with the wheel gears when in the relaxed plate finger position, the plate finger and wheel gears for cooperably drive-advancing the indexing wheel relative to the cover construction the angular rotational degree, the spring member being supported by the planar push plate portion in radial adjacency to the push plate hub, the push plate post being received in the select angled slot, the spring member being compressible intermediate the planar push plate and upper cover portions, the push plate thereby being spring-biasable and movable intermediate an upper wheel-advancing position and a lower gear-resetting position, the push plate post and angled slot for converting axially-directed force into wheel-advancing force, the ring flange for providing stop structure to the push plate thereby defining the lower gear-resetting position when the spring member forces the push plate in an axial direction away from the upper cover portion, the container fastening means for fastening the cap assembly to the cover construction, the upwardly extending container rim for forcing the planar push plate portion toward the wheel-advancing position when the cap assembly is attached to the container, the spring member for forcing the planar push plate portion toward the wheel-resetting position when the cap assembly is detached from the container.

9. The indexing cap assembly of claim 8, wherein the cover hub comprises a hub slot and the push plate comprises a push plate rib, the push plate rib extending radially from the push plate hub for meshing with the hub slot.

10. The indexing cap assembly of claim 8, wherein the upper wheel portion of the indexing wheel comprises an upper surface, the upper surface comprising a series of radially-extending indicia, the radially-extending indicia being sized and shaped for visual inspection via the indicator window.

11. The indexing cap assembly of claim 8, wherein the push plate comprises a container-aligning skirt, the container-aligning skirt extending axially downward from the planar push plate portion, the container-aligning skirt having a skirt radius cooperating with a container rim radius for locating and enhancing proper alignment of the cap assembly relative to the container when attaching the cap assembly to the container.

12. The indexing cap assembly of claim 8, wherein swing plate comprises three angled slots and the push plate comprises three push plate posts, the angled slots being circumferentially spaced substantially 120 degrees from the push plate posts so as to enhance conversion of axially directed force into rotational force.

13. An indexing container and closure assembly comprising:

a bottle for storing medication, the bottle comprising an upper neck having an exterior fastener;

a cap removably mounted to the bottle, the cap comprising:

an indexing wheel comprising a top surface having a series of indicia, a wheel skirt, and wheel gears extending downwardly from the top surface;

a cover comprising a closed top having an indicator window, a cover skirt, and a cover hub having a slot, the cover housing the indexing wheel, and the cover rotatably cooperating with the indexing wheel to track cap removal occurrences and display through the indicator window a set of indicia of the series of indicia corresponding to the cap removal occurrences;

a spring;

a swing plate comprising an outer hub surface having at least one angled slot;

a push plate comprising:

a planar portion having an upwardly extending hub, the planer portion supporting the spring and engaging the upper neck of the bottle to rotate the indexing wheel an angular distance, a rib extending radially inward from the hub and engaging the slot of the cover hub;

at least one post received in the at least one angled slot of the swing plate;

an assembly ring comprising a fastener engaging the exterior fastener of the bottle.

14. The indexing container and closure assembly of claim 13, wherein the at least one angled slot is three angled slots and the at least one post is three posts, the angled slots being circumferentially spaced substantially 120 degrees from the posts.

15. The indexing container and closure assembly of claim 13, wherein the indicia are arranged radially and sized for visual inspection through the indicator window.

16. The indexing container and closure assembly of claim 13, wherein the push plate comprises a container-aligning skirt extending axially downward from the planar portion of the push plate, the container-aligning skirt engaging the neck of the upper neck of the bottle.

17. The indexing container and closure assembly of claim 13, wherein the swing plate comprises a plate finger and the indexing wheel comprises at least one wheel finger, the at least one wheel finger step-advancing the indexing wheel relative to the cover, the plate finger drive-advancing the indexing wheel relative to the cover.

* * * * *